US006988997B2

(12) United States Patent
Stultz

(10) Patent No.: US 6,988,997 B2
(45) Date of Patent: Jan. 24, 2006

(54) BACK MASSAGER WITH INTERCHANGEABLE CONTACT HEADS

(76) Inventor: Michael O. Stultz, 25626 Silver Dollar, Lake Forest, CA (US) 92630

( * ) Notice: Subject to any disclaimer, the term of this patent is extended or adjusted under 35 U.S.C. 154(b) by 213 days.

(21) Appl. No.: 10/456,864

(22) Filed: Jun. 6, 2003

(65) Prior Publication Data

US 2004/0249325 A1 Dec. 9, 2004

(51) Int. Cl.
*A61H 1/00* (2006.01)

(52) U.S. Cl. ..... 601/135; 601/137; D24/211; D24/214

(58) Field of Classification Search ..... 601/1, 601/19, 27, 39, 46, 71, 72, 73, 80, 118, 119, 601/133, 134, 135, 137, 138; 606/204; 607/79; D24/211, 214, 215; 482/79, 132, 140
See application file for complete search history.

(56) References Cited

U.S. PATENT DOCUMENTS

| | | | | |
|---|---|---|---|---|
| 1,265,082 A | | 5/1918 | Hoard | |
| 1,533,528 A | | 4/1925 | Weaver | |
| 2,168,975 A | * | 8/1939 | Clarke | 601/138 |
| 2,577,129 A | | 4/1951 | Johnston et al. | |
| 4,266,536 A | | 5/1981 | Casares | |
| 4,452,237 A | * | 6/1984 | Lewis | 601/134 |
| 4,493,315 A | | 1/1985 | Iwahashi | |
| 5,364,338 A | | 11/1994 | Terashima | |
| 5,730,708 A | | 3/1998 | Spratt | |
| 5,848,980 A | | 12/1998 | Demerais | |
| 5,935,090 A | | 8/1999 | Kennon | |
| 6,241,693 B1 | | 6/2001 | Lambden | |
| 6,251,089 B1 | | 6/2001 | Kuznets et al. | |
| D452,572 S | | 12/2001 | Nakamura | |
| 6,332,873 B1 | | 12/2001 | Naruse et al. | |
| 6,419,650 B1 | | 7/2002 | Ryan et al. | |
| 6,758,826 B2 | * | 7/2004 | Luettgen et al. | 601/135 |

* cited by examiner

*Primary Examiner*—Danton D. DeMille
*Assistant Examiner*—Quang D. Thanh
(74) *Attorney, Agent, or Firm*—Gene Scott; Patent Law & Venture Group

(57) ABSTRACT

An exercise and massage apparatus has a pair of elongate handles, each of the handles providing a curved distal end and a plurality of interchangeable massage heads. Each of the massage heads includes a massage plate supporting plural massage fingers. The massage plate is in face-to-face contact with a handle plate supporting the handles. A releasable engagement means enables the plates to be mutually secured and released so the handles are able to control the massage fingers with the massage fingers forming an acute angle with the handles whereby the massage fingers are positionable in contact with a user's back with the handles manipulated from over the user's shoulders.

4 Claims, 2 Drawing Sheets

BACK MASSAGER WITH INTERCHANGEABLE CONTACT HEADS

RELATED APPLICATIONS

This application relates to U.S. Provisional application Ser. No. 60/354,087 filed Jan. 31, 2002, and entitled "Acuciser." A copy of this document is enclosed herewith.

BACKGROUND OF THE INVENTION

INCORPORATION BY REFERENCE: Applicant(s) hereby incorporate herein by reference, any and all U.S. patents, U.S. patent applications, and other documents and printed matter cited or referred to in this application.

1. Field of the Invention:

This invention relates generally to manual exerciser and massage devices and more particularly to a back exerciser-stimulator with interchangeable contact heads.

2. Description of Related Art

The following art defines the present state of this field:

Nakamura, U.S. Des. 452,572 describes an acupressure device design.

Hoard, U.S. Pat. No. 1,265,083 describes a horizontal bar, a pair of handles affixed to said bar, a pair of central members also affixed to near the center of said bar, said central members being each provided at its outer end with a roller bearing adapted as said handles are moved to traverse the head, neck and spine of the user.

Weaver, U.S. Pat. No. 1,533,528 describes a massage instrument comprising, in combination, a shaft having threaded ends, a handle member, having a threaded socket, secured to one end of said shaft, said member having a ball raceway a ball raceway threadedly secured to the other end of said shaft, a tubular member surrounding said shaft, a massage roller on said tubular member, said tubular member leaving a ball race at each end, balls between said tubular member and said raceways, a washer on said shaft, said washer baying a diameter somewhat greater than the tubular member, and a handle portion engaging said shaft and engaging said washer.

Johnston et al., U.S. Pat. No. 2,577,129 describes a massaging device comprising a pair of opposite side frames, each of said frames terminating at the lower end in a coiled portion, a handle secured between the top ends of said side frames; and a resilient roller carried between said coiled portions and adapted to be raised when said side frames are rocked in one direction on said coiled portions for applying a rolling pressure to the back of a person lying upon said roller.

Casares, U.S. Pat. No. 4,266,536 describes a back massager capable of massaging the user's back without assistance. The massager has a curved shaft having a handle near the first end and a second handle positioned at an intermediate point between the first and second ends of the shaft. The shaft is curved and has roller means affixed at the second end thereof.

Iwahaski, U.S. Pat. No. 4,493,315 describes a massage means utilizing a resilient deformable structure, comprising: a right-hand bar; a left-hand bar; an intermediate stick having one end joined to one end of the right-hand bar and the other end joined to one end of the left-hand bar, the center portion of the intermediate bar being made of a resilient material; and a pair of pressing members disposed at the both sides with respect to the center portion of the intermediate bar with a space provided therebetween in the longitudinal direction of the intermediate bar.

Terashima, U.S. Pat. No. 5,364,338 describes a portable massager allowing self-massaging to be performed in virtually any position. The massager includes at least one pair of pressers mounted at a fixed separation interval onto a rod, which can be separated into two sections, if desired. The pressers may be freely rotatable or non-rotably fixed in position on the rod. The surfaces of the pressers are formed into irregular shapes having indentations and projections. Handles having grips on their ends are either fixed or mounted so as to rotate freely on the rod and project outwardly away from the pressers and toward a respective end of the rod.

Spratt, U.S. Pat. No. 5,730,708 describes a massager for the back portion of the human body having two identical handlebars in an arched configuration. One end of each handlebar being flattened and hinged to each end of a rolling dual ended pivot in such a way that handlebars form an oval when free ends meet. Handlebars having a length and arch such that they encompass a human torso when free ends meet. Cylindrically shaped pivot having bumper pad cover. One or more massage members are removably secured by retaining knobs to the inside of arched handlebars closer to the hinged ends thereof. Retaining knobs protrude through a plurality of adjustment holes in handlebar and thread into female threaded massage members.

Demerais, U.S. Pat. No. 5,848,980 describes a hoop shaped massage apparatus and method, and more particularly a versatile massage apparatus with a hoop shaped handle and a universal bracket for receiving a conventional massage unit. The hand held hoop is preferably attached to a conventional "off the shelf" commercially available vibrator. The hoop is adjustably sized to encircle a person's torso, trunk, shoulders or any other portion of the body. The vibrator is removably attached to the hoop by a bracket that includes a hook and loop fastener strap and tabs to hold the massage unit in place. Additionally, the bracket mounts upon the hoop. The hoop is positioned around a selected body area of a user to conveniently and comfortably apply pressure to the massaged portion of the user's body. The hoop acts as guides and leverage arms, aiding the user in applying massage pressure to the massaged area of the body. The massage unit can be a vibrating massage unit of conventional design, or can be a non-vibrating massage device, or a heat massage device.

Kennon, U.S. Pat. No. 5,935,090 describes a device for treating muscular ailments. The device has a generally U-shaped frame. The frame has an elongated cross-member with a handle extending perpendicularly outwardly from each of two terminal ends of the cross-member. The device has a protrusion extending perpendicularly outwardly from the cross-member in the same direction as the handles. The protrusion can be either of a rectangular block or a roller and can be positionable along the longitudinal axis of the cross-member. In another aspect of the invention, a method is provided for using a device with a U-shaped frame and a protrusion to self-administer treatment for muscular and spinal ailments. The method involves locating a body part needing treatment and positioning the protrusion directly over the body part. Pressure is then applied to the body part by the protrusion. Additional pressure may be applied if necessary by using the handles and the cross-member of the device as levers. The protrusion is then repositioned a short distance away from the original position and pressure is reapplied.

Lambden, U.S. Pat. No. 6,241,693 describes an apparatus and a method for applying pressure to the body of a person. The apparatus comprises an arcuate shaft, a handle that extends from the arcuate shaft in a plane intersecting the plane of the arcuate shaft, and a pressure applicator movably attached to the arcuate shaft for applying pressure to the body. The apparatus can be used for massaging or for applying acupressure.

Kuznets et al., U.S. Pat. No. 6,251,089 describes a body and joints massage device having changeable massage heads to obtain selected stroking, rubbing and/or kneading massaging effects of all body parts including body joints. The body and joints massage device comprises a shaft housing engaging a main rotating shaft, the shaft housing being formed suitable to grip by a user and may be engaged with different types of massage heads. One type includes actively rotating and actively self-rotating massage elements each equipped with passively rotating rollers for body stroking and rubbing massage effects. Another type includes actively rotating, flexible and/or extended massage elements each of which also performs an active or passive reciprocal linear or arc movement for body and/or joints massage effect. Yet another type includes actively rotating extended massage elements, in which each also performs an active or passive reciprocal arc movement for body and joints massage.

Naruse et al., U.S. Pat. No. 6,332,873 describes a massaging apparatus including a head unit, a pair of housings and a pair of arms. The head unit is configured to massage a body of a user. The pair of housings are connected to opposite sides of the head unit respectively and extend in opposite directions from the head unit. The pair of arms are configured to be held by the user and provided to the pair of housings respectively. The pair of arms are flexible.

Ryan et al, U.S. Pat. No. 6,419,650 describes a device for providing back massage with simultaneous accupressure stimulation along either side of the spine. The device comprises a frame in which are disposed a plurality of rollers which are freely rotatable and capable of being interchangeably positioned within the frame. One roller is of a larger diameter than the remaining rollers and is provided with a central circumferential groove which is bounded on each side by a surface having a plurality of nubs. In use, the nubs contact the user's body on either side of the spine at the desired location to provide accupressure stimulation. By providing the accupressure stimulation roller in a diameter which is larger than the other rollers, the device also provides intervertebral or intersegmental extension during use.

The prior art teaches hand held acupressure devices, and massage devices, appliances, instruments, and exercisers, including sliding and rolling devices and multidirectional devices. The prior art also teaches a device for treating muscular ailments. These devices are specifically designed for the back but may, as well, be applied to other portions of the body. However, the prior art does not teach a hand-held back massage and exercising device with snap-in replaceable heads for applying various types of massage contact wherein the heads and the handle are joined by face-to-face mounting plates. The present invention fulfills these needs and provides further related advantages as described in the following summary.

SUMMARY OF THE INVENTION

The present invention teaches certain benefits in construction and use which give rise to the objectives described below.

An exercise and massage apparatus has a pair of elongate handles, each of the handles providing a curved distal end and a plurality of interchangeable massage heads. Each of the massage heads includes a massage plate supporting plural massage fingers. The massage plate is in face-to-face contact with a handle plate supporting the handles. A releasable engagement means enables the plates to be mutually secured and released so the handles are able to control the massage fingers with the massage fingers forming an acute angle with the handles whereby the massage fingers are positionable in contact with a user's back with the handles manipulated from over the user's shoulders.

A primary objective of the present invention is to provide an apparatus and method of use of such apparatus that provides advantages not taught by the prior art.

Another objective is to provide such an invention capable of providing various types of massage through the use of interchangeable massage heads.

A further objective is to provide such an invention capable of replacement of massage heads with a manual insert, turn and lock joining mechanism, yet providing a strong engagement between handles and massage heads.

A still further objective is to provide such an invention capable of reaching all parts of a user's back with light or heavy massage pressure from an over the shoulder control of the apparatus.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
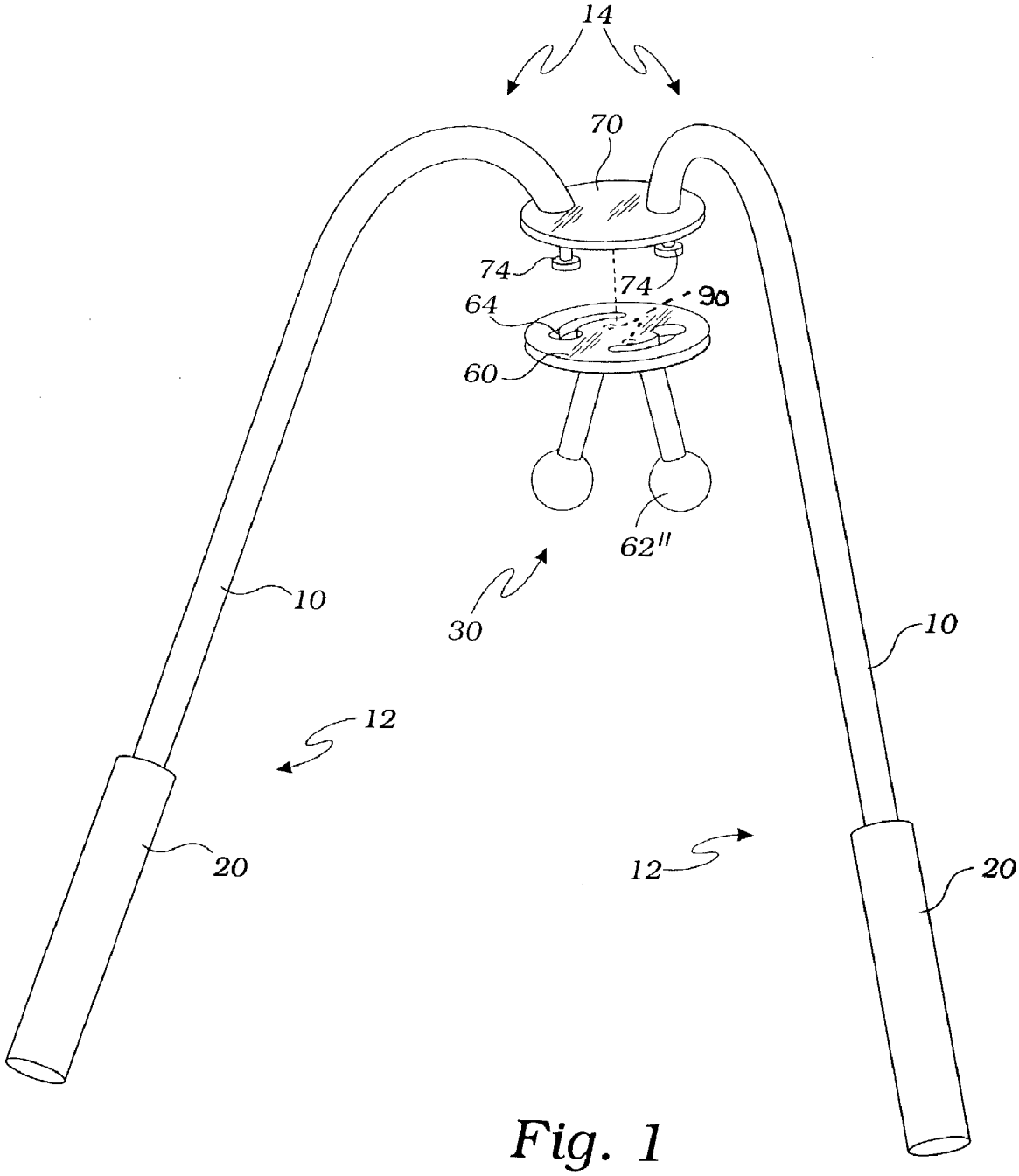
FIG. 1 is an exploded perspective view of the preferred embodiment of the invention shown with one of the plural replaceable heads disconnected.
Figure 3:
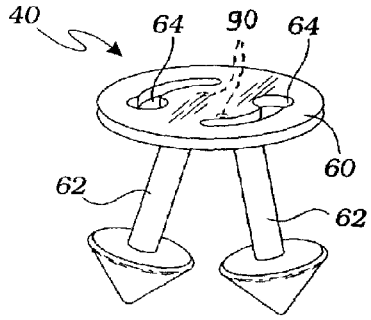
FIG. 3 is a perspective view of an alternate head thereof.
Figure 4:
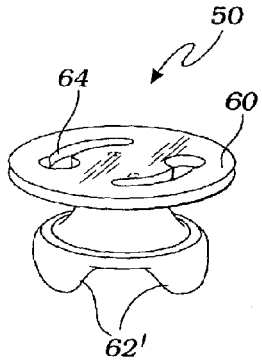
FIG. 4 is a perspective view of a further alternate head thereof.
Figure 5:
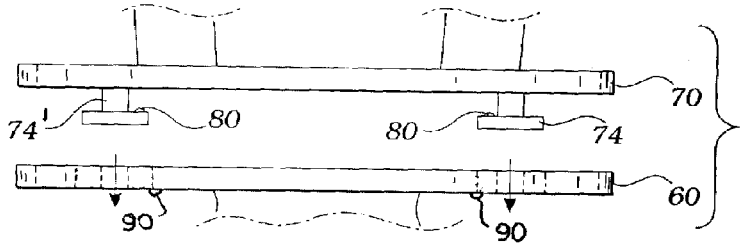
FIG. 5 is a side elevational partial view thereof showing the manner in which the plates of the invention are positioned for engagement.
Figure 6:
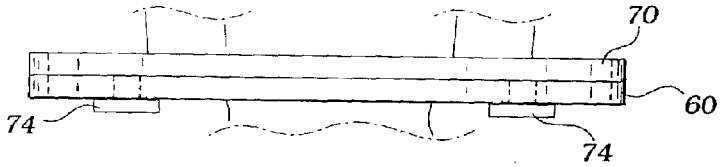
FIG. 6 is a similar view to that of FIG. 5, but here showing the plates fully engaged in face-to-face contact.

The present invention is primarily a back massage apparatus, but may be used for exercise as well during massage sessions. It comprises a pair of elongate handles 10 as best seen in FIG. 1, wherein each of the handles 10 preferably provides a grip 20 at a proximal end 12 and a curved portion at a distal end 14. A plurality of massage heads 30, 40 and 50 each providing a massage plate 60, and extending outwardly from the massage plate 60, a pair of massage fingers, designated alternately as 62" in FIG. 1, 62 in FIG. 3, and 62' in FIG. 4. The massage plate 60 provides a first engagement means 64, preferably a pair of round holes having slots extending from each of the holes 64, wherein the slots are arranged in a circular pattern as best seen in FIGS. 3 and 4.

Figure 2:
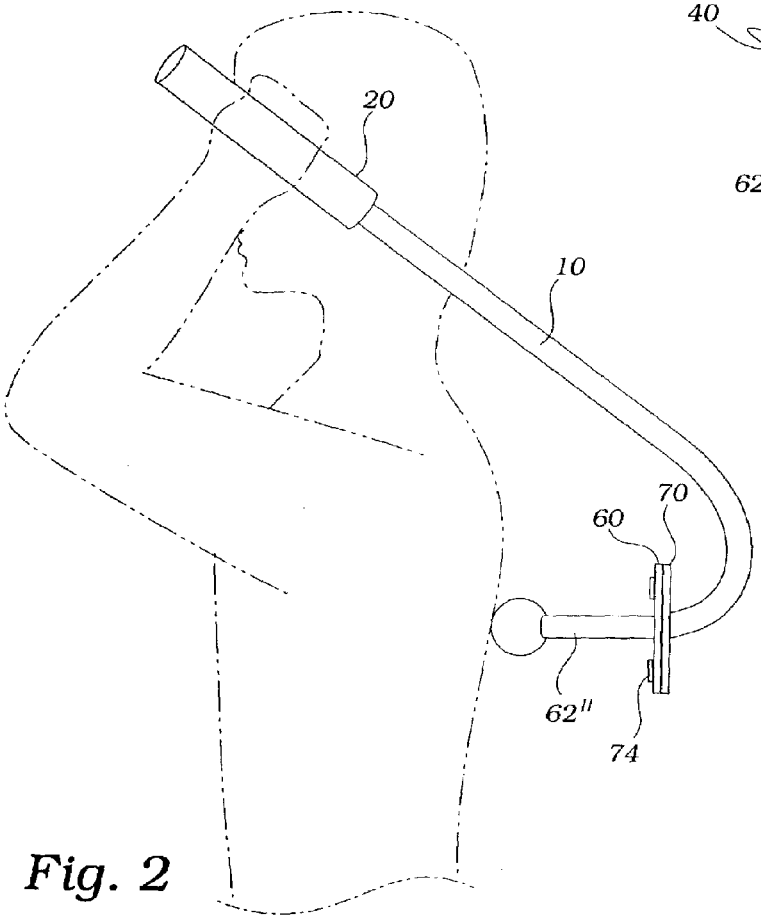
FIG. 2 is a side elevational view thereof depicting use of the apparatus for massage and exercise.

As shown in FIG. 2, a handle plate 70 is rigidly joined to the handles 10, with the handles 10 extending divergently from one side of the handle plate 70. This is clearly shown in FIG. 1 as well. The handle plate 70 further provides a second engagement means 74, preferably a pair of rods 74' extending normally from an opposing side of the handle plate 70, with each of the rods 74' terminating with a disc 80 of larger diameter than the rods 74'. The first and second engagement means 64, 74 are mutually engagable for securement of the massage and handle plates 60, 70 and are also mutually releasable for separation of the massage and handle plates 60, 70. Engagement and release is accomplished by rotation of the massage plate 60 relative to the handle plate 70.

In the figures the massage plate 60 provides the first engagement means 64 (holes and slots) and the handle plate 70 provides the second engagement means 74 (rods and discs). Clearly, the opposite arrangement (not shown) is equally functional where the massage plate 60 would provide the second engagement means 74 (rods and discs) and the handle plate 70 would provide the first engagement means 64 (holes and slots). In this arrangement the discs 80 are slightly smaller in diameter than the holes and therefore are able to be inserted into the holes. After insertion, the rods 74' are moved through the slots away from the holes by rotating the massage plate 60. The lengths of the rods 74', are just long enough to enable the discs 80 to fully penetrate the holes. This results in a strong face-to-face contact of the plates 60, 70. A pair of bumps 90 are located on the surface against which the discs 80 slide and are in positions to lock the plates 60, 70 when the rods 74' are against the terminal ends of the slots, i.e., a significant force must be exerted to move the discs onto or off-of the bumps 90. Alternate means for locking the plates would be obvious to those of skill in the art.

When engaged, the plates 60, 70 are in full face-to-face contact over a relatively wide area, which improves the ability of the massage plate 60 to transfer forces to the handle plate 70 efficiently. This is because of the relatively large contact face area. Thus, the mounting of the massage plate 60 on the handle plate 70, is relatively easy to do, quick and secure.

As shown in FIGS. 1, 3 and 4, the massage fingers terminate preferably with spherical surfaces, FIGS. 1 and 4, or conical surfaces, FIG. 3, of various sizes for enabling simple massages or more deeply probing massages.

Because the handles 10 have an arcuate bend at their distal ends 14, it is possible to achieve accurate and aggressive placement and motion of the fingers against selected portions of the back. Because the fingers preferably are paired, it is possible to massage both sides of the spine simultaneously, and because the handles 10 are relatively long, it is possible to reach all portions of the back from above the shoulders.

It is considered critical to the advantage and benefit of the present invention to provide for engagement of the massage plate 60 with the handle plate 70 by a rotation of one of the plates relative to the other of the plates. Such rotation provides for relative ease of engagement, secure engagement since such rotation does not occur through use of the invention and the enablement of such rotation locking of the plates is easily facilitated through inexpensive manufacturing steps.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. An exercise and massage apparatus comprising in combination:

a pair of elongate handles, each of the handles providing a curved distal end; a plurality of interchangeable massage heads, each of the massage heads including a massage plate; and extending outwardly from the massage plate, plural massage fingers; the massage plate providing a first engagement means for engaging the pair of elongate handles integrally to the massage fingers with the massage fingers forming an acute positive angle with the handles wherein the massage fingers are positionable in contact with a user's back with the handles manipulated from over the user's shoulders; the engagement means requiring a rotation of the massage plate for engagement and for release and further comprising a handle plate rigidly engaged with the elongate handles, the handles extending divergently therefrom; the handle plate further providing a second releasable engagement means; the first and second engagement means mutually engagable for securement of the massage and handle plates in full face-to-face contact, and mutually releasable for separation of the massage and handle plates.

2. The apparatus of claim 1 wherein one of the first and second engagement means is plural holes with slots extending therefrom in a circular pattern, and the other of the first and second engagement means is plural rods terminating with discs, each of the discs engaged with one of the holes, the rods movable through the slots by rotation of one of the plates relative to the other of the plates.

3. The apparatus of claim 2 further providing bumps on one or the plates in a position for locking engagement with the discs.

4. The apparatus of claim 1 wherein the massage fingers terminate with one of spherical and conical surfaces.

* * * * *